US008016080B2

(12) United States Patent
Rossato

(10) Patent No.: US 8,016,080 B2
(45) Date of Patent: Sep. 13, 2011

(54) LIFTING PLATFORM WITH A TORSION BAR

(75) Inventor: Eride Rossato, Mirano (IT)

(73) Assignee: O.ME.R. S.p.A., Milan (IT)

( * ) Notice: Subject to any disclaimer, the term of this patent is extended or adjusted under 35 U.S.C. 154(b) by 696 days.

(21) Appl. No.: 12/083,770

(22) PCT Filed: Oct. 16, 2006

(86) PCT No.: PCT/EP2006/067466

§ 371 (c)(1),
(2), (4) Date: Apr. 18, 2008

(87) PCT Pub. No.: WO2007/045640

PCT Pub. Date: Apr. 26, 2007

(65) Prior Publication Data

US 2009/0120722 A1 May 14, 2009

(30) Foreign Application Priority Data

Oct. 18, 2005 (IT) ..... VE2005A0053

(51) Int. Cl.
*B66F 7/10* (2006.01)
*B66F 7/12* (2006.01)

(52) U.S. Cl. ..... 187/207; 187/213; 187/286

(58) Field of Classification Search ..... 187/213, 187/214, 215, 267, 270, 272, 274, 250, 251, 187/207, 208, 286, 287; 254/353, 354, 360, 254/361; *E04H 6/06; B66F 7/02, 7/28, 7/10, 7/12*

See application file for complete search history.

(56) References Cited

U.S. PATENT DOCUMENTS

| | | | | |
|---|---|---|---|---|
| 2,750,004 | A * | 6/1956 | Harrison | 187/207 |
| 3,246,777 | A * | 4/1966 | Tabordon | 414/545 |
| 3,275,170 | A * | 9/1966 | MacRae et al. | 414/545 |
| 4,436,183 | A * | 3/1984 | Laurich-Trost | 187/224 |
| 4,706,458 | A * | 11/1987 | Corghi | 60/546 |
| 5,887,680 | A * | 3/1999 | Carson et al. | 187/240 |
| 2006/0169957 | A1 * | 8/2006 | Gilman | 254/223 |

FOREIGN PATENT DOCUMENTS

| | | |
|---|---|---|
| EP | 8082 A1 * | 2/1980 |
| EP | 0 030 983 | 7/1981 |

* cited by examiner

*Primary Examiner* — Michael Mansen
*Assistant Examiner* — Stefan Kruer
(74) *Attorney, Agent, or Firm* — Themis Law

(57) ABSTRACT

A lift device of platform type for miscellaneous loads, in particular for motor vehicles, comprising a pair of vertical uprights (2) to rest on the floor, a load carrying platform (4) slidable along said uprights (2), a drive system for said platform comprising actuators associated with the two uprights (2), and a torsion bar (6) applied to said platform to ensure that this latter is also horizontal when an unbalanced load is present, characterised in that at least one sprocket wheel (14) is applied to said torsion bar (6) and cooperates with a stop pawl (16) elastically engaging the teeth of said sprocket wheel (14) and disengageable from it during the descent phase of said platform (4).

12 Claims, 1 Drawing Sheet

LIFTING PLATFORM WITH A TORSION BAR

The present invention relates to a lift device of platform type for miscellaneous loads, in particular for motor vehicles.

Lift devices for miscellaneous loads and in particular for motor vehicles are known. They comprise a fixed support structure, with two vertical columns or uprights anchored to the floor, and with a platform slidable along these columns to lift the load placed thereon. Associated with the platform there is a drive system with actuators of various types, for example hydraulic cylinder-piston units, preferably housed in the columns.

The presence of these actuators positioned to the sides of the platform could result in irregular platform lifting, especially if an unbalanced load is present, and for which it has already been proposed (see for example IT 1,294,588) to maintain the platform horizontal under all conditions, even with the unbalanced load present, by applying a rack to each upright, and to the platform a torsion bar provided at its ends with two pinions engaged in the two racks. In this manner any platform load unbalances are absorbed by the torsion bar, which slightly deforms to ensure that the platform remains substantially horizontal in any position along the uprights and under any load condition.

For safety reasons the known lifts of this type require that when the platform is in a raised position it must be prevented from suddenly failing, even in the case of accidental breakage of the actuators. This has been achieved up to the present time for example by applying a pair of pawls on the two sides of the platform at the two uprights, and a plurality of stops along the uprights, at a distance apart corresponding to predetermined locking levels.

In operation, as the platform is raised, the two pawls positioned in it engage the stops applied to the uprights as they pass by, to ensure mechanical locking of the platform to the uprights should the lifting system suddenly yield.

Although from the mechanical safety viewpoint these known devices have proved reliable, they have at the same time highlighted a series of drawbacks, which the present invention proposes to eliminate.

One of these drawbacks is that generally only a limited number of safety stops are provided, meaning that the position at which the platform stops at the desired levels may not coincide with, and even be distant from, the position in which mechanical safety locking is required.

Another drawback is that to avoid this latter problem, a large number of safety stops must be used, this substantially increasing construction costs, especially as the stops have to be installed on both uprights.

Another drawback is that the safety locking positions are generally not provided along the entire upright, but only starting from a certain height, with the result that there is no mechanical safety in those platform positions close to the floor.

Another drawback is that in the case of accidental damage to a safety stop positioned to one side of the platform, this is supported only on the other side, and hence under totally unbalanced conditions.

All these drawbacks are eliminated according to the invention by a lift device of platform type for miscellaneous loads, in particular for motor vehicles, an embodiment of which is described hereinafter.

A preferred embodiment of the invention is further described hereinafter with reference to the accompanying drawings, in which.

Figure 1:
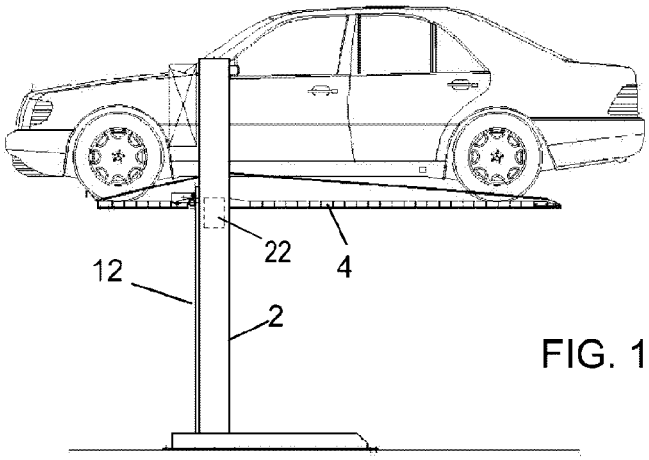
FIG. 1 is a side view of a safety device according to the invention.
Figure 2:
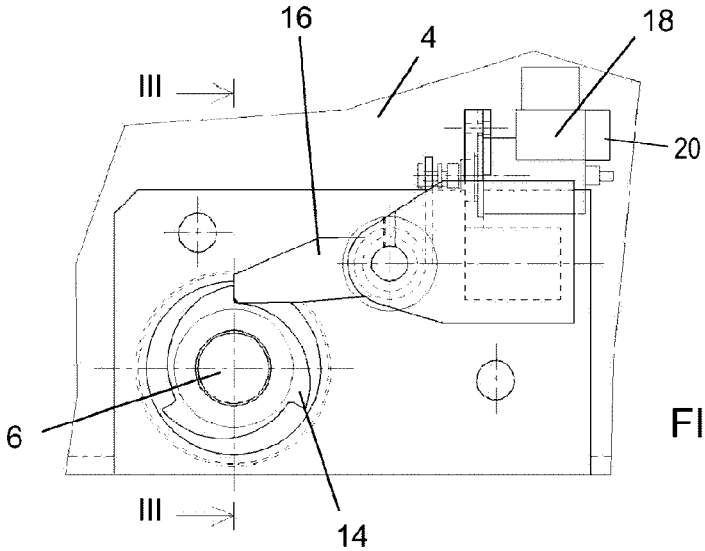
FIG. 2 is a side view of an enlarged detail of a safety device applied to the torsion bar.
Figure 3:
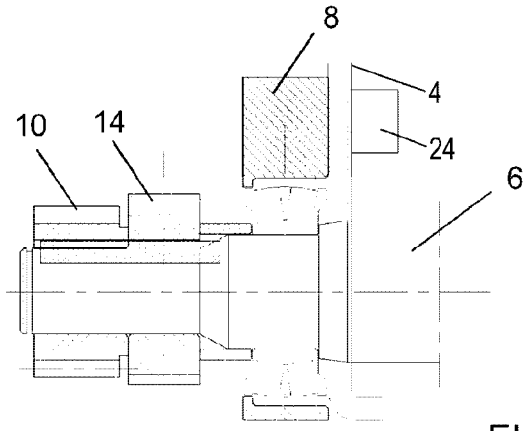
FIG. 3 shows the section III-III of FIG. 2, taken on the axis of the torsion bar.

As can be seen from the figures, the safety device of the invention is applied to a lift comprising a platform 4 interposed between two uprights 2 and slidable therealong under the action of a pair of vertical cylinder-piston units housed within each upright 2, they being fed by a central hydraulic unit and connected to the platform 4 to drive it in both directions.

As the platform drive system, the actuators and the transmission members are traditional, they have been omitted from the present description and do not in themselves form part of the invention.

A torsion bar 6 applied to the platform 4 consists of a metal tubular element dimensioned on the basis of the maximum force predicted on the platform 4 under unbalanced load conditions, and emerges from the two sides of the platform via a pair of supports 8.

On those portions of the torsion bar 6 emerging from the platform 4 there are keyed two gearwheels 10, which are constantly engaged in vertical racks 12 applied to the two uprights 2. To each portion of the torsion bar 6 to the side of each gearwheel 10 there is applied a sprocket wheel 14 associated with a stop pawl 16 pivoted to the side of the platform 4 in such a manner as to elastically engage the teeth of the corresponding sprocket wheel 14.

The teeth of the sprocket wheel 14 are of sawtooth profile, in the sense that the teeth have a slightly inclined and curved side, so that the corresponding stop pawl 16 enables the torsion bar 6 to freely rotate when the platform is raised, but prevents this rotation when the platform is lowered.

With the stop pawl 16 there is also associated a magnetic actuator 18, the function of which is to disengage the pawl from the sprocket wheel 14, against the elastic means which tend to maintain it engaged.

The operation of the lifting device of the invention is the following:

during the raising of the platform 4 along the uprights 2 the engagement between the gearwheels 10, rigid with the torsion bar 6, and the racks 12, rigid with the uprights 2, causes said torsion bar to rotate in the direction allowed by the engagement between the sprocket wheels 14 and the corresponding stop pawls 16.

When the desired level has been reached, the platform 4 can no longer descend because of the engagement of the stop pawls 16 in the teeth of the sprocket wheels 14, so that said stop pawls 16 constitute the mechanical safety stops for the platform 4.

To cause the platform to descend, the magnetic actuators 18 must firstly be operated to disengage the stop pawls 16 from the respective sprocket wheels 14.

Essentially, because of the interaction between the stop pawls 16, sprocket wheels 14, torsion bar 6, gearwheels 10 and racks 12, the torsion bar not only performs its traditional function of compensation member for any load unbalance on the platform 4, but also performs the new function of mechanical safety member for the platform against failing, in the case of an accidental fault in the lifting system.

This new function of the torsion bar 6 itself has many advantages, and in particular:

virtually instantaneous mechanical locking of the platform 4 at any level, mechanical safety achieved with a single device instead of with two, halting the descent of the platform 4 in positions much closer together than is possible with traditional safety devices, to hence obtain secure height positioning of the platform 4 at a large number of different levels, starting from ground level.

It must be noticed how the safety members of the lifting device, consisting in the interaction between the stop pawls 16 and the sprocket wheels 14 are active only in the lifting phase of the platform and also in the condition when the platform is still and in lifted condition, but are deactivated in order to allow the descent of the platform itself. Consequently, in case of accidental fault in the lifting system during the descent phase of the platform, its sudden fall is not avoided.

In order to avoid this, systems for the control of the speed of descent are associated to the platform, and when they detect a speed higher than the one fixed as maximum, which is preferably equal to the speed of descent in ordinary operating conditions, they control the re-engagement of the stop pawls 16 in the respective sprocket wheels 14.

An advantageous system for controlling the descent speed of the platform is constituted by a sensor of the rotation speed of the torsion bar 6. It may be constituted by an encoder or an inductive sensor 20 operating on the feeding circuit of the magnetic actuators 18, deactivating them and so allowing the elastic means associated to the stop pawls 16 to provoke their engagement in the respective sprocket wheels 14.

Another advantageous system for controlling the descent speed of the platform 4 is constituted by a sensor 22 of the linear speed of the platform itself. It may be a laser sensor or else an ultrasound sensor which, as in the former case, operates on the feeding circuit of the magnetic actuators 18. Still another advantageous system is a sensor 24 of the rotation speed of the torsion bar 6, which in different embodiments may be an encoder or may be inductive.

The invention claimed is:

1. A lift device comprising:

a pair of vertical uprights;

a load carrying platform slidable along said uprights;

a drive system for said platform comprising actuators associated with the two uprights; and a torsion bar applied to said platform, wherein a sprocket wheel is applied to each end region of said torsion bar and cooperates with a stop pawl configured to engage teeth of said sprocket wheel, said stop pawl being disengageable from the teeth during a descent phase of said platform, and wherein said sprocket wheel at each end region of said torsion bar causes said platform to remain horizontal under an unbalanced load condition.

2. The device as claimed in claim 1, further comprising a stop pawl actuator associated with each stop pawl to disengage said stop pawl from said sprocket wheel.

3. The device as claimed in claim 2, wherein said stop pawl actuator is magnetic.

4. The device as claimed in claim 2, further comprising means for detecting descent speed of said platform and means operating on said stop pawl actuator for deactivation of actuation when a fixed speed value is exceeded.

5. The device as claimed in claim 4, wherein the means for detecting the descent speed of said platform comprises a sensor of rotation speed of said torsion bar.

6. The device as claimed in claim 5, wherein said sensor of the rotation speed of the torsion bar comprises an encoder.

7. The device as claimed in claim 5, wherein said sensor of the rotation speed of the torsion bar is inductive.

8. The device as claimed in claim 4, wherein the means for detecting the descent speed of said platform comprises a sensor of linear speed of the platform.

9. The device as claimed in claim 8, wherein said sensor of the linear speed is a laser.

10. The device as claimed in claim 8, wherein said sensor of the linear speed is ultrasound.

11. The device as claimed in claim 1, wherein said torsion bar emerges from each side of said platform by a portion which is supported by a support and which carries said sprocket wheel and a gearwheel keyed thereon, said stop pawl being applied to a side of said platform.

12. The device as claimed in claim 1, wherein the teeth of said sprocket wheel are of sawtooth shape such to enable the torsion bar to undergo rotation upon rising of said platform, but to prevent rotation during said descent phase.

* * * * *